US007213901B2

(12) United States Patent
Bibl et al.

(10) Patent No.: US 7,213,901 B2
(45) Date of Patent: May 8, 2007

(54) TILT HEAD CLEANER

(75) Inventors: Andreas Bibl, Los Altos, CA (US); John A. Higginson, Santa Clara, CA (US)

(73) Assignees: Heidelberger Druckmaschinen AG, Heidelberg (DE); Dimatix, Inc., Lebanon, NH (US)

( * ) Notice: Subject to any disclaimer, the term of this patent is extended or adjusted under 35 U.S.C. 154(b) by 0 days.

(21) Appl. No.: 10/982,746

(22) Filed: Nov. 4, 2004

(65) Prior Publication Data

US 2005/0093913 A1 May 5, 2005

Related U.S. Application Data

(63) Continuation of application No. PCT/US2004/018712, filed on Jun. 11, 2004, and a continuation of application No. 10/458,822, filed on Jun. 11, 2003, now abandoned.

(51) Int. Cl.
*B41J 2/165* (2006.01)

(52) U.S. Cl. ..... 347/22; 347/32; 347/33

(58) Field of Classification Search ..... 347/22–33
See application file for complete search history.

(56) References Cited

U.S. PATENT DOCUMENTS 4,825,227 A 4/1989 Fischbeck et al.
5,265,315 A 11/1993 Hoisington et al.
5,365,843 A 11/1994 House et al.
5,534,897 A * 7/1996 Anderson et al. ..... 347/32
6,193,353 B1 * 2/2001 Vives et al. ..... 347/29
6,497,472 B2 * 12/2002 Sharma et al. ..... 347/28

FOREIGN PATENT DOCUMENTS

JP 9-1827 * 6/1995

* cited by examiner

*Primary Examiner*—Stephen Meier
*Assistant Examiner*—Ly T. Tran
(74) *Attorney, Agent, or Firm*—Laurence A. Greenberg; Werner H. Stemer; Ralph E. Locher

(57) ABSTRACT

A cleaning member is pivotally fixed to a support member to clean ink-jet print heads that are positioned on a print-head receptor module. The cleaning member pivots from a cleaning position to an idle position and the print-head receptor module is pivotally fixed to a support member to allow the module to pivot from a printing position to a cleaning position. The pivotal supports are positioned such that, when the module and the cleaning member are each in their respective cleaning positions, the cleaning member is positioned to clean ink jets inserted into the receptors.

23 Claims, 9 Drawing Sheets

TILT HEAD CLEANER

CROSS-REFERENCE TO RELATED APPLICATIONS

This application is a continuation application of and claims priority under 35 U.S.C. §120 to U.S. application Ser. No. 10/458,822, filed on Jun. 11, 2003 now abandoned. This application is also a continuation application of and claims priority under 35 U.S.C. §120 PCT/US2004/018712, filed on Jun. 11, 2004, which claims the benefit of U.S. application Ser. No. 10/458,822.

TECHNICAL FIELD

This invention relates to cleaning ink-jet printing apparatus, particularly apparatus used for commercial printing.

BACKGROUND

Commercial printing may be done on multi-color continuous web printing presses. Paper rolls are unrolled along a paper path that includes separate stations for each color. An optional dryer may be placed after the final print station. The web is then slit into sheets and stacked.

In ink-jet printing, ink is ejected from a narrow orifice in the direction of a substrate. In one type of ink-jet printing, known as drop-on-demand printing, the ink is ejected in a series of droplets. The droplets may be produced and controlled using a piezoelectric ink-jet head which has a large number of orifices, each of which is separately controllable to selectively eject ink at desired locations, or pixels, of the image. For example, an ink-jet head may have 256 orifices that have spacing for a printing resolution of at least 100 pixels (dots) per inch (dpi) and sometimes far more than that. This dense array of orifices allows complex, highly accurate images to be produced. In high performance print heads, the nozzle openings typically have a diameter of 50 microns or less, e.g., around 25 microns, are separated at a pitch of 25–300 nozzles/inch, have a resolution of 100 to 3000 dpi or more, and provide drop sizes of about 1 to 70 picoliters (pl) or less. Drop ejection frequency is typically 10 kHz or more. A drop-on-demand piezoelectric print head is described in U.S. Pat. No. 4,825,227, the entire contents of which is incorporated herein by reference.

While such dense arrays of orifices produce complex, highly accurate images, image quality can deteriorate if one or more of the orifices become obstructed. For example, a partially obstructed orifice may alter the direction, size, or stability of the droplets. It is important to keep these apertures open and functional to avoid degradation of print quality. It is also important to clean the ink jets quickly without undue equipment down time. Moreover, since position of the ink jets relative to the paper is important, cleaning the heads should not unnecessarily dislocate the print-head module and should return it as close to its original position as possible.

SUMMARY

In general, in a first aspect, the invention features an apparatus including a print bar for mounting a print head and a first pivot coupling to allow the print bar to pivot to or from a printing position.

Embodiments of the apparatus may include one or more of the following features and/or features of other aspects.

The apparatus may further include a cleaner in a cleaning position, wherein the pivot coupling allows the print bar to pivot (e.g., by about 90°) to a cleaning position in proximity to the cleaner. Additionally, the apparatus may include a second pivot coupling to allow the cleaner to pivot (e.g., by about 90°) between the cleaning position and an idle position. The print bar may be substantially non-parallel to the web when in the cleaning position (e.g., orthogonal to the web). The cleaner can use a vacuum to clean the print bar when the print bar and the cleaner are in their respective cleaning positions. The cleaner can use a cleaning fluid (e.g., a solvent) with or without a vacuum to clean the print bar when the print bar and the cleaner are in their respective cleaning positions. The cleaner can span the print bar.

The apparatus may include a print support to register the print bar relative to a web when the print bar is in the printing position. The print bar and the support can include mating features that couple when the print bar is in the printing position. Alternatively, or additionally, the print bar and the cleaner can include mating features that couple when the print bar is in the cleaning position. The print bar may be substantially parallel to the web when in the printing position.

In some embodiments, a print head mounted on the print bar jets ink substantially orthogonal to the web when the print bar is in the printing position.

In a further aspect, the invention features a single-pass, web-based print station including the apparatus.

In general, in another aspect, the invention features an apparatus for cleaning ink-jet heads mounted on a print bar. The apparatus includes a print bar pivotally fixed to a first support member to allow the print bar to pivot from a printing position to a cleaning position, and a cleaner adjustably coupled to a second support member to allow the cleaner to adjust from a cleaning position to an idle position, wherein the first support member is fixed relative to the second support member.

Embodiments of the apparatus may include one or more of the following features and/or features of other aspects.

The cleaner can be positioned to clean print heads mounted on the print bar when the print bar and the cleaner are each in their respective cleaning positions. The print bar and the cleaner can include mating features that couple when the print bar and the cleaning bar are each in their respective cleaning positions. The print bar and the first support member can include mating features that couple when the print bar is in the printing position.

The apparatus can further include a drive to pivot the print bar and a drive to adjust the cleaning bar. In addition, the apparatus can include a controller to control the print bar pivot drive and the cleaning bar adjustment drive. The controller can include a processor to: (a) activate the print bar pivot drive to pivot the print bar to the printing position and the cleaning bar adjustment drive to adjust the clear bar to the idle position; and (b) activate the print bar pivot drive to pivot the print bar to the cleaning position and the cleaning bar adjustment drive to adjust the clear bar to the cleaning position. The apparatus can include a limit sensor to stop pivoting the print bar to the printing position and to stop adjusting the cleaning bar to the idle position, and to activate the print bar pivot drive to pivot the print bar to the cleaning position and the cleaning bar adjustment drive to adjust the cleaning bar to the cleaning position.

The print bar can include mating features that engage mating features on the cleaner or first support.

In general, in a further aspect, the invention features a method of cleaning print heads mounted on a print bar, where the print bar is pivotally fixed to a first support member to allow the print bar to pivot from a printing position to a cleaning position. The method includes: (a) providing a cleaning bar adjustably coupled to a second support member to allow the cleaning bar to adjust from a cleaning position to an idle position, the print bar being positioned such that, when the print bar and the cleaning bar are each in their respective cleaning positions, the cleaning bar is positioned to clean print heads mounted on the print bar; (b) pivoting the print bar from the printing position to the cleaning position; (c) adjusting the cleaning bar from the idle position to the cleaning position; and (d) cleaning print heads mounted on the print bar.

The method may be implemented using the aforementioned apparatus.

Embodiments may include one or more -of the following advantages. Print head cleaning can be accomplished quickly and easily without disassembly of the printing system. The printing heads can be carried on a single moveable print bar which avoids realignment of the heads relative to one another after cleaning. The print bar motion is achieved by a pivoting coupling which permits highly accurate, reproducible realignment of the print bar with the substrate path after cleaning, and does not require movement of the paper path to access the face of the print heads. The cleaning apparatus can also be moved into a cleaning position by pivoting motion. Cleaning can be accomplished in a small physical space.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols indicate like elements.

DETAILED DESCRIPTION

Figure 1:
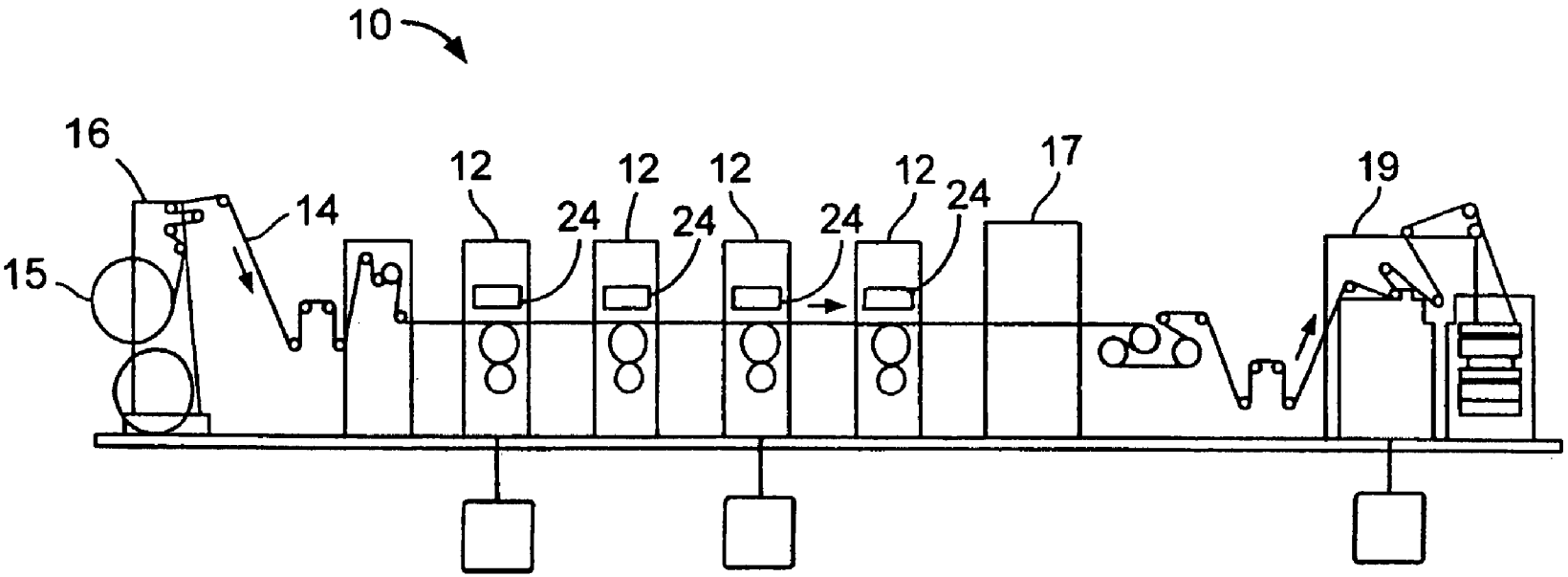
FIG. 1 shows a generalized scheme for a commercial printing apparatus.
Figure 2A:
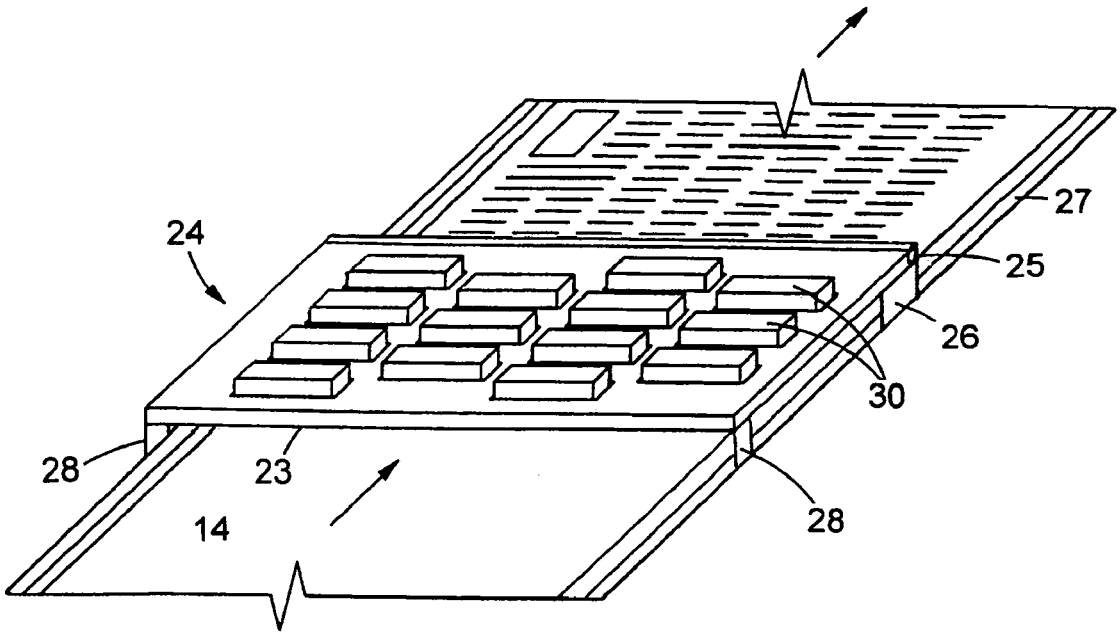
FIGS. 2A and 2B are perspective views of a print bar.
Figure 2B:
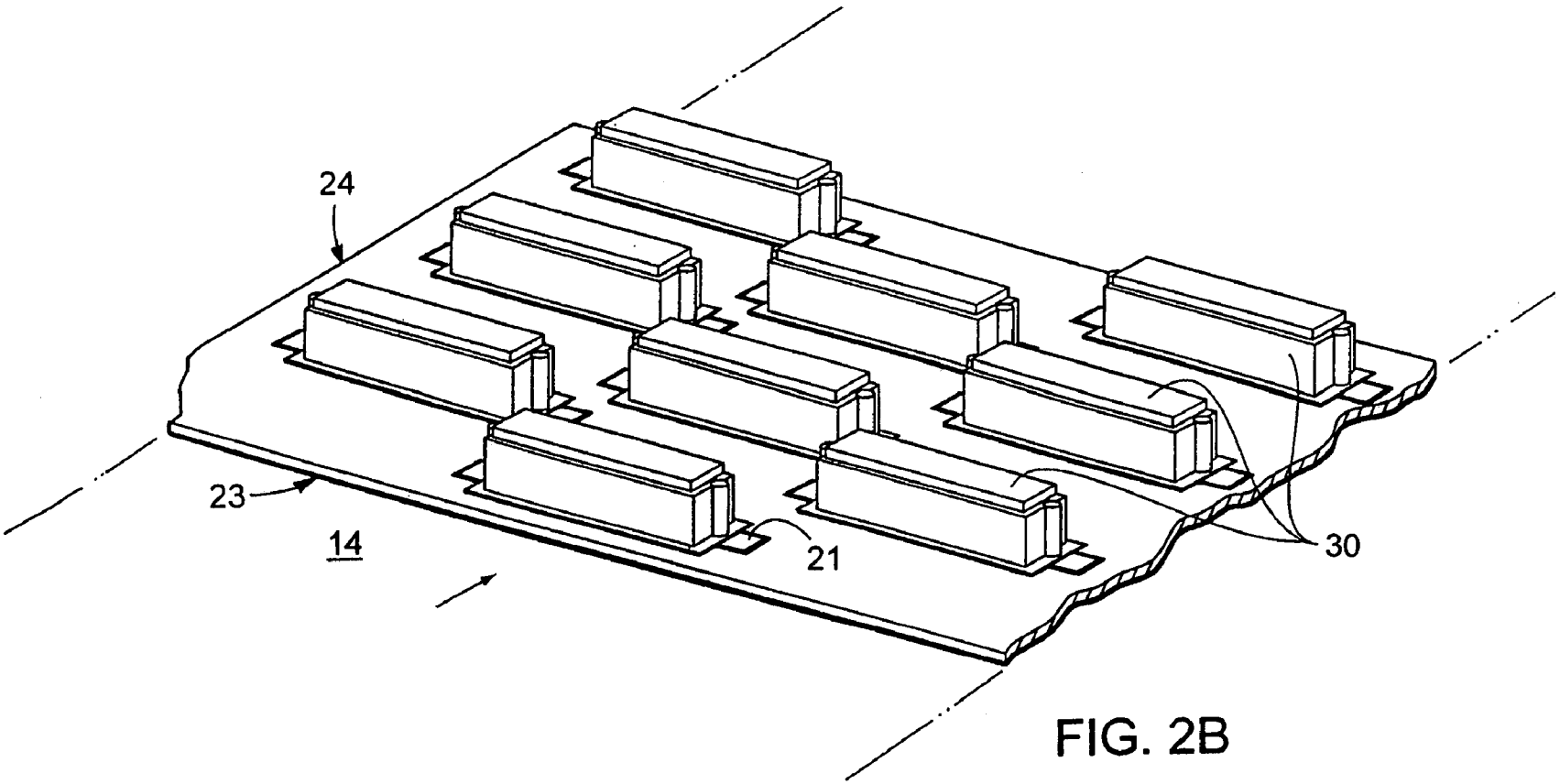

Referring to FIG. 1, a continuous web printing press layout 10 includes a series of stations or printing towers 12 for printing different colors onto a moving web 14. The web 14 is driven from a supply roll 15 on stand 16 onto a paper path that leads sequentially to print stations 12. An optional dryer 17 may be placed after the final print station. After printing, the web is slit into sheets that are stacked at station 19. For printing wide-format webs, such as newsprint, the print stations accommodate a web width of about 30–33 inches or more. The web feed rate is in the range of about 3 meters/second or more. A general layout for offset lithographic printing that can be adapted for ink-jet printing is further described in U.S. Pat. No. 5,365,843, the entire contents of which is hereby incorporated by reference. Referring as well to FIG. 2A and 2B, each print station includes a print bar 24. The print bar 24 is a mounting structure for print heads 30 which are arranged in an array and from which ink is ejected to render a desired image on the web 14. The printheads 30 are mounted in print bar receptacles 21 such that the faces of the printheads from which ink is ejected are exposed from the lower surface or face 23 of the print bar 24 (see also FIG. 4B). The print bar receptacles 21 also include mating features complementary to alignment features on the printheads to assure proper alignment of the printheads relative to one another. The print heads 30 can be arranged in an array to offset nozzle openings to increase printing resolution or printing speed.

In a printing position, the print bar 24 is arranged above the web path to provide proper alignment and a uniform stand-off distance between the print heads 30 and the web 14. In typical arrangement, the stand off distance between the web path and the print bar is between about 0.5 and one millimeter. The print heads 30 can be of various types, including drop on demand ink-jet print heads with arrays of small, finely spaced nozzle openings. Piezoelectric ink-jet print heads are described in Hoisington U.S. Pat. No. 5,265,315, Fishbeck et al. U.S. Pat. No. 4,825,227 and Hine U.S. Pat. No. 4,937,598, the entire contents each of which is hereby incorporated by reference. Other types of print heads can be used with the print bar, such as, for example, thermal ink jet print heads in which heating of ink is used to effect ejection. Continuous ink-jet heads, that rely on deflection of a continuous stream of ink drops can also be used.

Figure 3A:
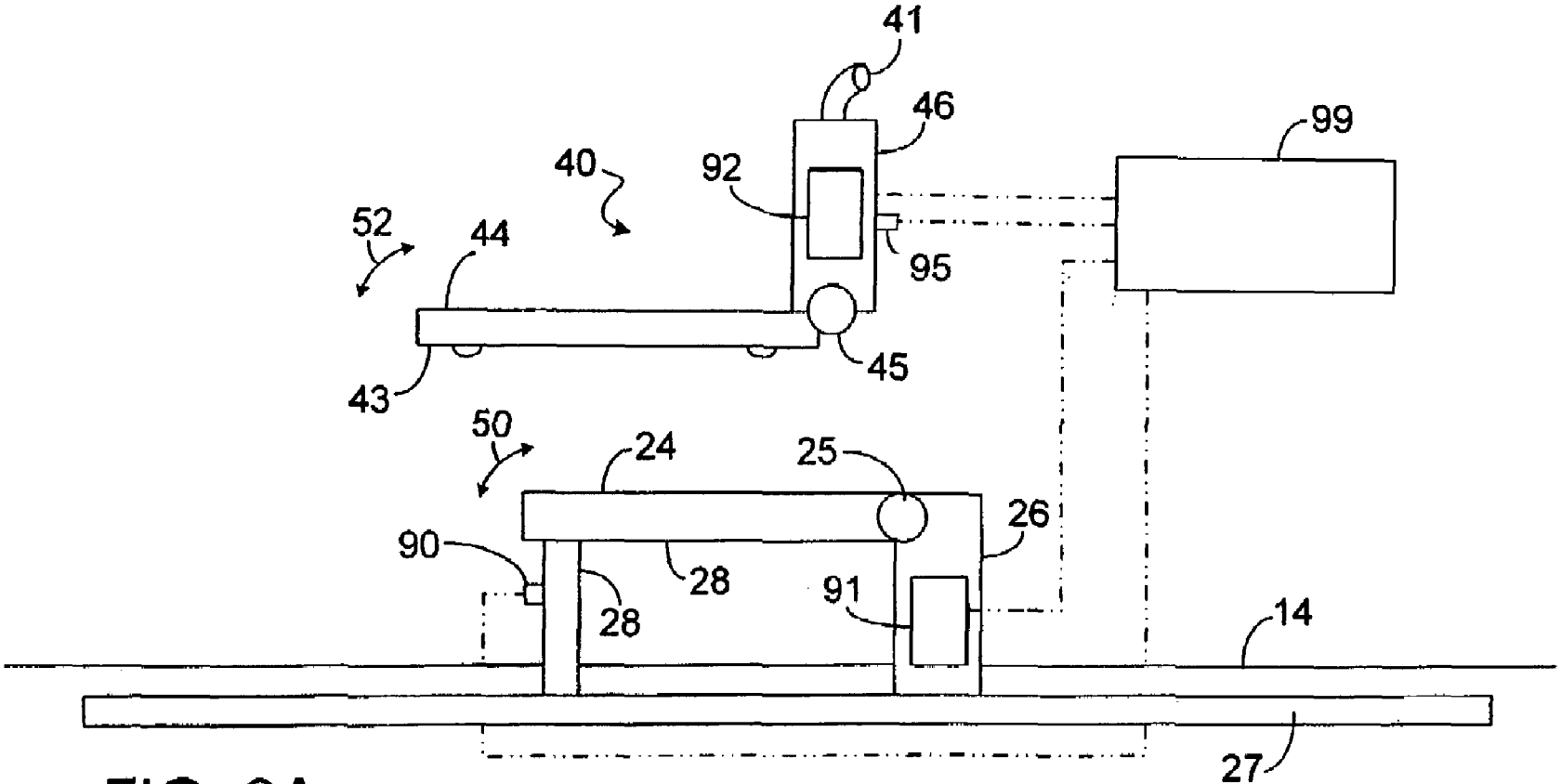
FIGS. 3A and 3B are side views of a print bar in a printing and cleaning position, respectively.
Figure 3B:
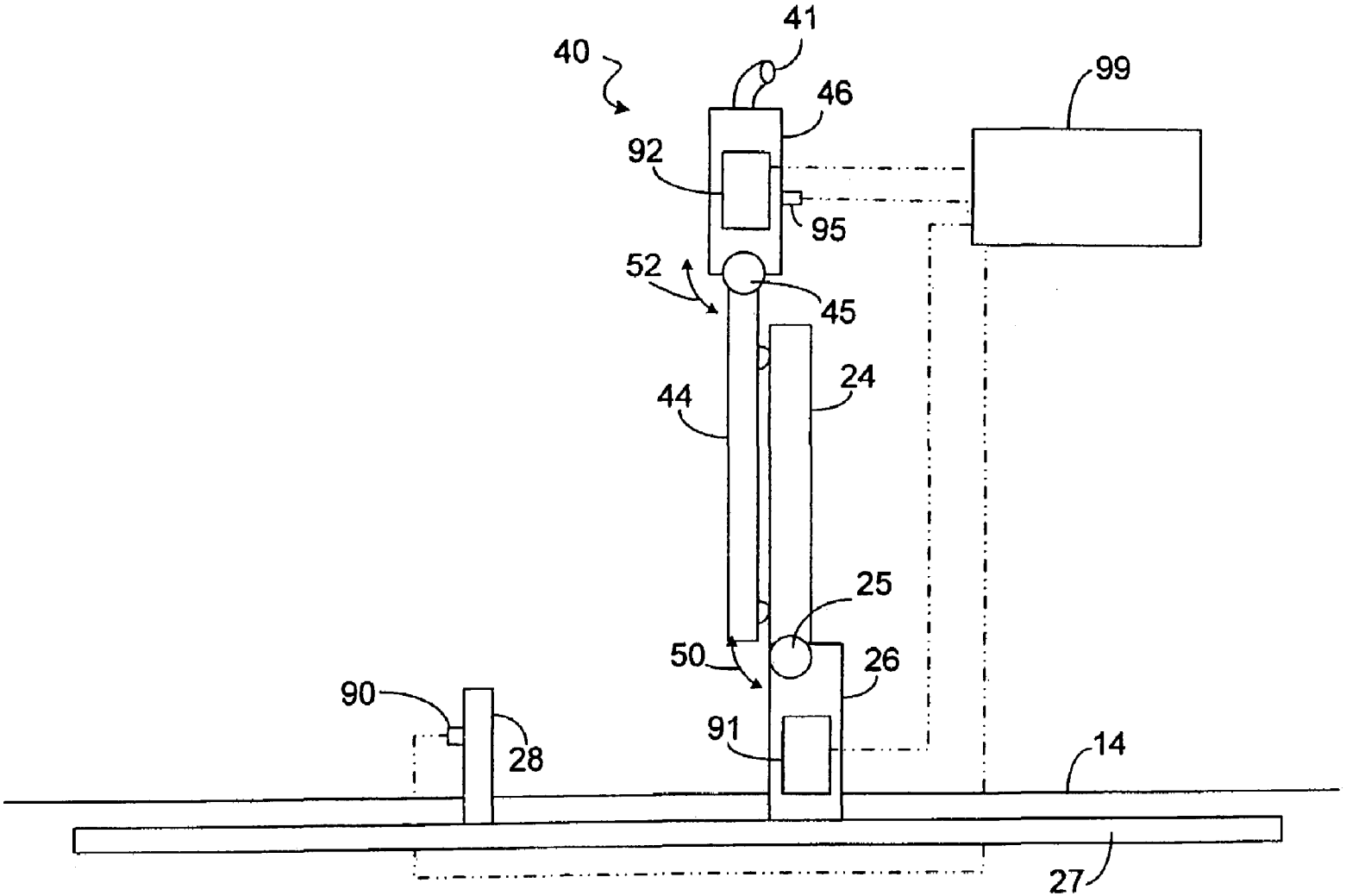

Referring as well to FIG. 3A and 3B, the print bar 24 can be pivoted (arrows 50) between a printing position (FIG. 3A) and a cleaning position (FIG. 3B). The print bar 24 is attached to a pivot rod 25. The pivot rod is rotatably coupled to a printing pivot base 26. The printing pivot base 26 is attached to a frame 27 which provides a guide for the web 14. The printing pivot base 26 is typically fixed relative to the web path. As illustrated in FIG. 3A, during printing, the print bar 24 is arranged in a generally parallel plane above the web path with face 23 of the print bar opposite the web 14. In this condition, the print bar 24 engages print supports 28, which are also attached to the frame 27 so that the print bar 24 is stabilized at a uniform stand-off distance from the web path. Referring as well to FIG. 4A, a view of the face 23 of the print bar, the print supports 28, engage the print bar 24 at mating features 29. The mating features 29, e.g., apertures, are shaped to uniquely mate with the supports 28, to assure alignment of the print bar 24 by minimizing skew in the plane of the print bar relative to the web path. More generally, the mating features can be any component(s) that assure print bar alignment. Examples include mechanical male and female interlocking features, magnetic components, vacuum seals, etc.

Continuing to refer to FIGS. 3A and 3B, to access the cleaning position, the print bar 24 is pivoted about an axis of rotation defined by the pivot rod, (arrows 50) to an orientation out of the plane parallel to the print path to facilitate access to the face 23 of the print bar and face 22 print heads to permit cleaning using a head cleaner system 40. The cleaning system 40 is connected to a vacuum source 41 to clean the faces of the print bar and print heads. The head cleaner system 46 includes a cleaning bar 44 fixed to a cleaner pivot rod 45. The cleaner pivot rod 45 is rotatably coupled to a cleaner base 46. The cleaner base 46 is attached to a frame (not shown) which is fixed relative to the printing bar base 26. As illustrated in FIG. 3A, during printing, the cleaning bar 44 is positioned so that it does not interfere with the print bar 24. For example, the cleaning bar 44 may be positioned above the printing bar 24 in a generally parallel plane. As illustrated in FIG. 3B, to effect cleaning the print bar 24 is pivoted (arrow 50) out of the plane parallel to the web path, e.g., into a plane perpendicular to the web path, and the cleaning bar is pivoted (arrow 52) into a plane parallel to and closely adjacent the face 23 of the print bar 24. Referring as well to FIG. 4A, the face 43 of the cleaning bar 44 includes alignment features 48, such as pins. In the cleaning condition, the alignment features 48 are shaped to engage the mating features 29, on the print bar. The alignment features 48 also define a stand off distance between the cleaning bar face 43 and the print bar face 23 to avoid substantial contact with the print heads so that the print heads are not disturbed from their relative alignment on the print bar and the delicate nozzle openings are not damaged.

Print bar base 26 includes a drive 91 (e.g., a stepper motor) that pivots print bar 24 between the printing position and the cleaning position. A controller 99 (e.g., including an electronic processor) controls the operation of print bar base drive 91. Cleaner base 46 also includes a drive 92, which adjusts cleaning bar 44 between its cleaning position and idle position. Controller 99 similarly controls the operation of cleaner base drive 92. Controller 99 is also in communication with limit sensors 90 and 95 (e.g., optical sensors or electrical contact sensors), which are attached to print supports 28 and cleaner base 46, respectively. Limit sensor 90 detects when print bar 24 is in the printing position and sends a signal to controller 99, causing the controller to disengage the print bar base drive. Similarly, limit sensor 95 detects when the cleaner bar is in the cleaning position or idle position and causes the controller to disengage the cleaning bar drive. In the present embodiment, sensors 90 and 95 are attached to the print supports and cleaner base, respectively, however, in general, the limit sensors can be positioned at any location from which they can detect an appropriate print bar or cleaning bar position. Additional sensors can be included. For example, an additional sensor may be positioned to detect when print bar 24 is in the cleaning position.

Figure 4B:
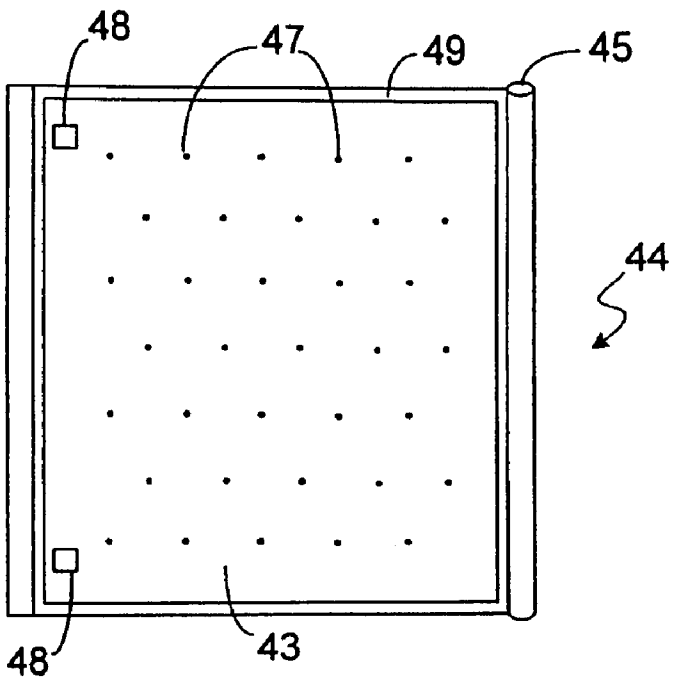
FIGS. 4A and 4B are views of a print bar face and cleaning bar face, respectively.
Figure 4A:
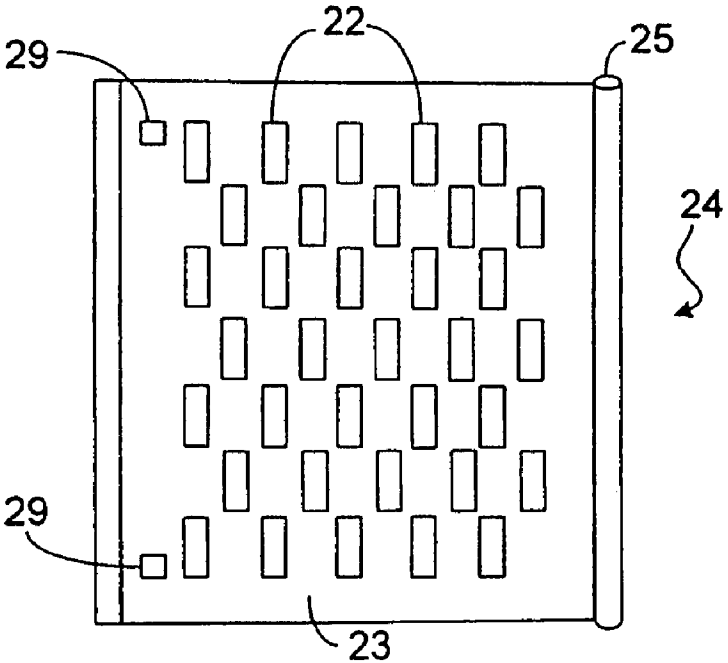

Referring to FIG. 4A and FIG. 4B, the face 43 of the cleaning bar 44 includes an array of vacuum apertures 47 which are in communication with the vacuum source. The vacuum apertures 47 are arranged in an array that complements the array of print heads 22 on print bar 24, such that in the cleaning condition a vacuum aperture is associated with each print head. A sealing ring 49 ensures an air tight seal between the face 43 of cleaning bar 44 and the face 23 of print bar 24 when the cleaning bar and print bar are in their cleaning positions (see FIG. 3B). Optionally, cleaning bar 44 can include wipers for wiping the print heads during cleaning.

Figure 5:
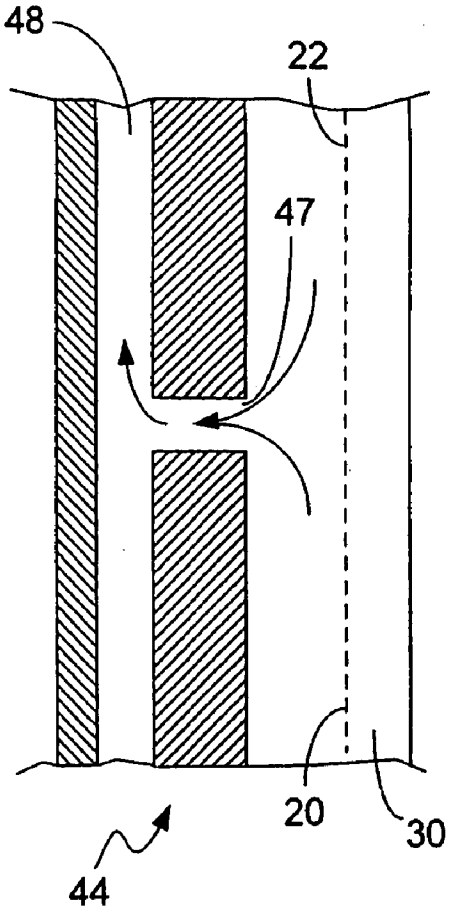
FIG. 5 is a greatly enlarged cross section of a portion of a cleaning bar and a print head in a cleaning position.

Referring to FIG. 5, a greatly expanded cross-sectional view illustrating a single vacuum aperture 47 opposite the face 21 of a print head, the force of the vacuum removes (arrows 54) debris such as ink residue, dust, web fibers, and the like which could interfere with the performance of the print head nozzles 20. The aperture 47 is in communication with a duct 48 which directs debris to collector, e.g., a filter (not shown).

Figure 6:
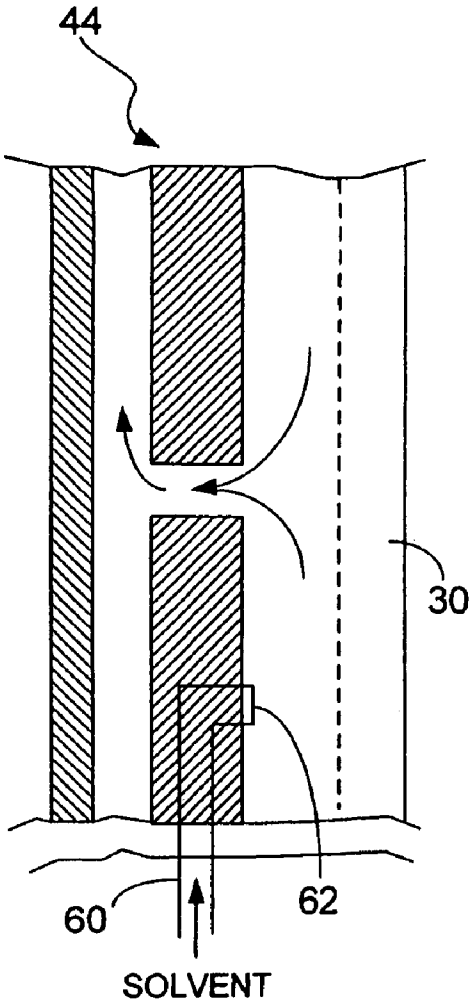
FIG. 6 is a greatly enlarged cross section of a position of an alternate cleaning bar and a print head in a cleaning position.

Referring to FIG. 6, in an alternate embodiment, a liquid solvent is supplied by conduit 60 to spray head 62. During cleaning, the solvent is sprayed prior to or during the airflow generated by the vacuum source, to assist in removal of debris that could clog the print head. The stand off distance between the face of the cleaning bar and the face of the print bar may be small, e.g., about five millimeters or less.

Figure 7:
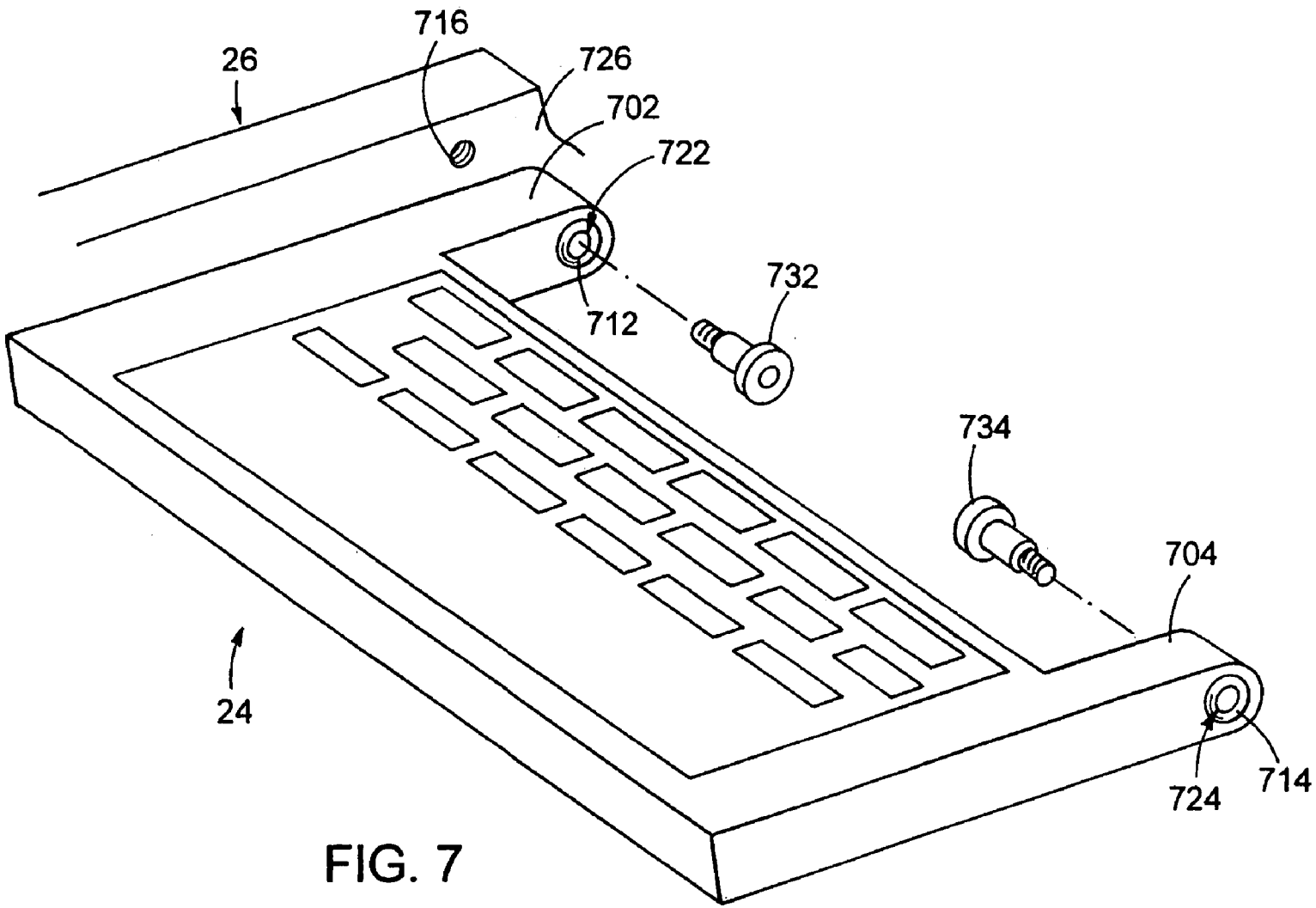
FIG. 7 is an exploded view of a pivoting coupling.

Referring to FIG. 7, an enlarged view of a pivoting coupling is provided. In FIG. 7, the pivot coupling is shown for print bar 24. A similar coupling can be used for the cleaning bar. Print bar 24 includes mounting tabs 702 and 704, each of which includes a hole, 712 and 714, in which ball bearings 722 and 724 are fixed. Shoulder bolts 732 and 734 extend through mounting tabs 702 and 704, respectively, and fasten to threaded holes in the side walls of print bar base 26. Only threaded hole 716 in base side wall 726 is shown in FIG. 7. The shaft of each shoulder bolt is precision machined to mate exactly with the inner race of the respective ball bearings. The shoulder bolts secure the print bar to the print bar base, but allow the bar to pivot around the bearing axes. The bar, pivot coupling components, and base can be machined from materials that exhibit high environmental stability (e.g., are stable for operational temperature and humidity ranges), such as stainless steel or invar.

Figure 8A:
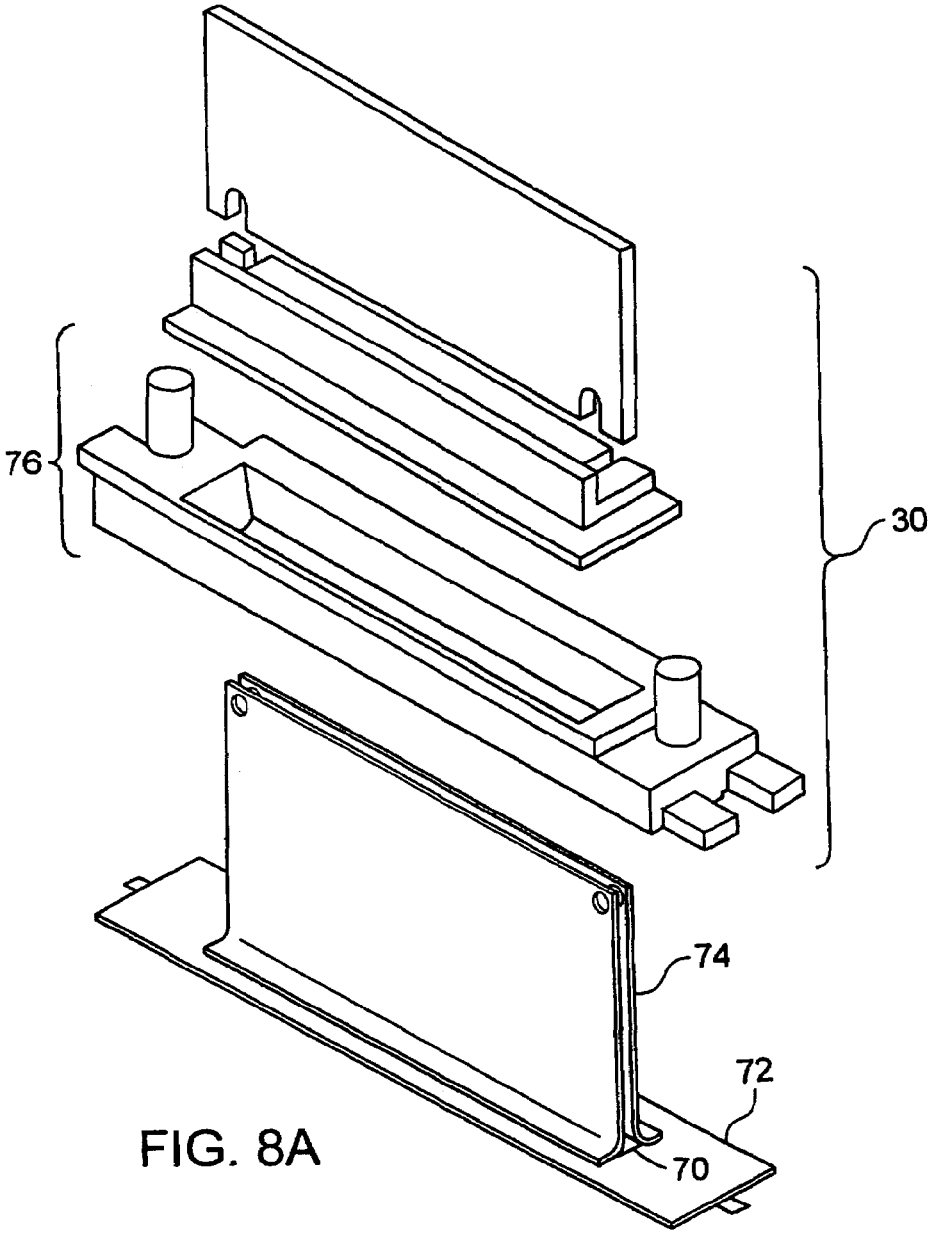
FIG. 8A is an exploded view of a print head and FIG. 8B is a plan view of a printhead face.
Figure 8B:
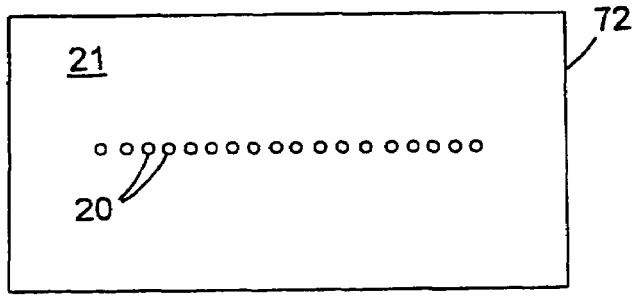

Referring to FIGS. 8A and 8B, a suitable print head includes a print head 30, module 70 which is positioned on a face plate 72 and to which is attached a flat print 74 delivery of drive signals that control ink ejection. The print head 30 includes ink path structure 76 for delivering ink to the module. The face 21 of the module includes an array of finely spaced nozzles 20 from which ink is ejected.

In embodiments, other cleaning arrangements can be used. For example, the cleaning bar need not extend the full width of the print bar. Instead, the cleaning bar can be indexed across the print bar. The cleaning bar can be moved into a cleaning position using assemblies other from pivoting arrangements. For example, the cleaning bar may be slid in a plane parallel to its plane or translated traverse to its plane into proximity of the printing bar after the printing bar has been pivoted from the printing condition. The cleaning can be accomplished by apparatus other than cleaning bar. For example, a vacuum hose could be translated across the face of the print bar to sequentially vacuum portions of the print bar. A wiper could be used to wipe debris from the face of the print bar.

In embodiments, other pivoting arrangements or orientations can be used. The axis of rotation of the pivot could be parallel to the web path. For example, the print bar could be coupled to a support at the edge of the web path or in the middle of the web path. The print bar and/or the cleaning bar may not be planar. For example, the print bar could have a curvature or receptacles that otherwise align printheads to follow a web path that has curvature. The cleaning bar can have a curvature complementary to the print bar curvature.

While particularly beneficial for a large-scale, single-pass web based print stations as illustrated in FIG. 1, the cleaning arrangement can be used with other printing arrangements in which components such as a paper path or guide make cleaning operations difficult. For example, the cleaning system can be used with printing stations in which printing is conducted by single or multiple passes of a print head over a single print substrate or sheet.

Still further embodiments are in the following claims.

What is claimed is:

1. An apparatus, comprising:

a print bar for mounting a print head;

a first pivot coupling to allow the print bar to pivot from a printing position to a cleaning position;

a pivotably mounted cleaner separate from the print bar, the cleaner being pivotable, independently of the print bar, into a cleaning position adjacent the print bar in the cleaning position; and a second pivot coupling to allow the cleaner to pivot between the cleaning position and an idle position.

2. The apparatus of claim 1, wherein the first pivot coupling allows the print bar to pivot to the cleaning position in proximity to the cleaner.

3. The apparatus of claim 2, wherein the print bar is substantially non-parallel to the web when in the cleaning position.

4. The apparatus of claim 2, wherein the cleaner uses a vacuum to clean the print bar when the print bar and the cleaner are in their respective cleaning positions.

5. The apparatus of claim 2, wherein the cleaner uses a cleaning fluid with or without a vacuum to clean the print bar when the print bar and the cleaner are in their respective cleaning positions.

6. The apparatus of claim 5, wherein the cleaning fluid is a solvent.

7. The apparatus of claim 2, wherein the cleaner spans the print bar.

8. The apparatus of claim 7, wherein the print bar comprises mating features that engage mating features on the cleaner or first support.

9. The apparatus of claim 1, further comprising a print support to register the print bar relative to a web when the print bar is in the printing position.

10. The apparatus of claim 9, wherein the print bar and the support comprise mating features that couple when the print bar is in the printing position.

11. The apparatus of claim 9, wherein the print bar and the cleaner comprise mating features that couple when the print bar is in the cleaning position.

12. The apparatus of claim 9, wherein the print bar is substantially parallel to the web when in the printing position.

13. The apparatus of claim 1, wherein a print head mounted on the print bar jets ink substantially orthogonal to the web when the print bar is in the printing position.

14. A single-pass, web-based print station comprising the apparatus of claim 1.

15. An apparatus for cleaning ink-jet heads mounted on a print bar, the apparatus comprising:

a print bar pivotally fixed to a first support member to allow the print bar to pivot from a printing position to a cleaning position; and a cleaner pivotably coupled, independently of the print bar, to a second support member to allow the cleaner to adjust from a cleaning position adjacent the print bar in the cleaning position to an idle position, wherein the first support member is fixed relative to the second support member.

16. The apparatus of claim 15, wherein the cleaner is positioned to clean print heads mounted on the print bar when the print bar and the cleaner are each in their respective cleaning positions.

17. The apparatus of claim 15, wherein the print bar and the cleaner comprise mating features that couple when the print bar and the cleaning bar are each in their respective cleaning positions.

18. The apparatus of claim 15, wherein the print bar and the first support member comprise mating features that couple when the print bar is in the printing position.

19. The apparatus of claim 15, further comprising a drive to pivot the print bar and a drive to adjust the cleaning bar.

20. The apparatus of claim 19, further comprising a controller to control the print bar pivot drive and the cleaning bar adjustment drive.

21. The apparatus of claim 15, wherein the print bar comprises mating features that engage mating features on the cleaner or first support.

22. A method of cleaning print heads mounted on a print bar, the print bar being pivotally fixed to a first support member to allow the print bar to pivot from a printing position to a cleaning position, the method comprising:

providing a cleaning bar pivotably coupled, independently of the print bar, to a second support member to allow the cleaning bar to adjust from a cleaning position adjacent the print bar in the cleaning position to an idle position, the print bar being positioned such that, when the print bar and the cleaning bar are each in their respective cleaning positions; the cleaning bar is positioned to clean print heads mounted on the print bar;

pivoting the print bar from the printing position to the cleaning position;

adjusting the cleaning bar from the idle position to the cleaning position; and cleaning print heads mounted on the print bar, wherein the first support member is fixed relative to the second support member.

23. An apparatus, comprising:

a print bar for mounting a print head; and a first pivot coupling to allow the print bar to pivot from a printing position to a cleaning position, a pivotably mounted cleaner pivotable, independently of the print bar, into a cleaning position, wherein the first pivot coupling allows the print bar to pivot into the cleaning position in proximity to the cleaner in the cleaning position and the cleaner spans the print bar, and a second pivot coupling to allow the cleaner to pivot between the cleaning position and an idle position.

* * * * *